US009834828B2

(12) United States Patent
Doty

(10) Patent No.: US 9,834,828 B2
(45) Date of Patent: Dec. 5, 2017

(54) CAST ALUMINUM ALLOY COMPONENTS

(71) Applicant: GM Global Technology Operations LLC, Detroit, MI (US)

(72) Inventor: Herbert W. Doty, Fenton, MI (US)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 645 days.

(21) Appl. No.: 14/265,995

(22) Filed: Apr. 30, 2014

(65) Prior Publication Data

US 2015/0315688 A1 Nov. 5, 2015

(51) Int. Cl.

| | |
|---|---|
| ***C22C 21/02*** | (2006.01) |
| ***C22C 21/00*** | (2006.01) |
| ***C22C 21/14*** | (2006.01) |
| ***C22F 1/00*** | (2006.01) |
| ***B22D 21/00*** | (2006.01) |
| ***B22D 27/04*** | (2006.01) |
| ***C22C 21/12*** | (2006.01) |
| ***C22C 21/16*** | (2006.01) |
| ***C22C 21/18*** | (2006.01) |
| ***C22F 1/04*** | (2006.01) |
| ***C22F 1/043*** | (2006.01) |
| ***C22F 1/057*** | (2006.01) |

(52) U.S. Cl.

CPC ..... *C22C 21/00* (2013.01); *B22D 21/007* (2013.01); *B22D 27/04* (2013.01); *C22C 21/02* (2013.01); *C22C 21/12* (2013.01); *C22C 21/14* (2013.01); *C22C 21/16* (2013.01); *C22C 21/18* (2013.01); *C22F 1/002* (2013.01); *C22F 1/04* (2013.01); *C22F 1/043* (2013.01); *C22F 1/057* (2013.01)

(58) Field of Classification Search

CPC ..... C22C 21/02; C22C 21/04; C22C 21/14

See application file for complete search history.

(56) References Cited

U.S. PATENT DOCUMENTS

| | | | | |
|---|---|---|---|---|
| 4,648,918 | A * | 3/1987 | Asano | C22C 21/02 148/417 |
| 2005/0199318 | A1 | 9/2005 | Doty | |
| 2008/0060723 | A1 | 3/2008 | Doty | |
| 2009/0252643 | A1 | 10/2009 | Doty et al. | |

FOREIGN PATENT DOCUMENTS

| | | | | |
|---|---|---|---|---|
| EP | 1728882 | A2 * | 12/2006 | B22D 11/0605 |
| JP | 02280992 | A * | 11/1990 | |

OTHER PUBLICATIONS

Davis, J.R. "Aluminum and Aluminum Alloys", ASM International, 1993, p. 45.*

* cited by examiner

*Primary Examiner* — Roy King
*Assistant Examiner* — Janelle Morillo

(57) ABSTRACT

Aluminum alloy components having improved properties. In one form, the cast alloy component may include about 0.6 to about 14.5 wt % silicon, 0 to about 0.7 wt % iron, about 1.8 about 4.3 wt % copper, 0 to about 1.22 wt % manganese, about 0.2 to about 0.5 wt % magnesium, 0 to about 1.2 wt % zinc, 0 to about 3.25 wt % nickel, 0 to about 0.3 wt % chromium, 0 to about 0.5 wt % tin, about 0.0001 to about 0.4 wt % titanium, about 0.002 to about 0.07 wt % boron, about 0.001 to about 0.07 wt % zirconium, about 0.001 to about 0.14 wt % vanadium, 0 to about 0.67 wt % lanthanum, and the balance predominantly aluminum plus any remainders. Further, the weight ratio of Mn/Fe is between about 0.5 and about 3.5. Methods of making cast aluminum parts are also described.

5 Claims, No Drawings

CAST ALUMINUM ALLOY COMPONENTS

FIELD OF THE INVENTION

This invention relates generally to aluminum alloys and more particularly to heat-treatable aluminum alloys that have improved mechanical properties and specifically strength at both room and elevated temperatures.

BACKGROUND TO THE INVENTION

Aluminum alloys have enjoyed widespread use because of their high strength-to-weight ratios and therefore have been used extensively for mass-reduction efforts. This has been a dominant theme in the automotive industry where fuel economy and emissions reduction have motivated manufacturers to reduce mass to improve efficiency. As efficiency targets extend to higher levels, mass reduction has been coupled with power-density increases to meet requirements. However, higher power density drives higher loading and temperature in the service environment.

Historically, aluminum alloys and their heat treatments have been developed for room-temperature or near room-temperature applications. In materials science, an application of an alloy is considered elevated-temperature if the service environment includes any more than brief exposure above one-half the homologous melting temperature of the alloy. The homologous temperature is a fraction of the melting point on the absolute temperature scale (Aluminum $T_{MP}$=660° C.+273=933 kelvin; 0.5 $T_{MP}$=465.5 kelvin or 193.5° C.). Thus, any application above 194° C. is considered a high-temperature application. Above 0.5 $T_{MP}$, different failure mechanisms become dominant in a component. For cylinder heads, the operating temperature routinely exceeds this value and in the near future, it is expected to increase another to between 0.55 and 0.58 $T_{MP}$.

The high-volume commercial aluminum alloys are primarily strengthened by two mechanisms: work-hardening and precipitation-hardening. For applications which require mass-produced complex shapes, such as automotive engine components, work-hardened alloys are not practical or economical, leaving precipitation-hardening via heat treatment as the primary method to achieve required mechanical properties. Precipitation hardening is achieved through different heat treat steps that manipulate the microstructure such that very fine strengthening phases can be formed in a controlled manner by varying the time at temperature during the aging process. These strengthening mechanisms have been developed for systems and products intended for use at room temperature or at slightly elevated temperatures. However, once the temperature of the operating environment rises above typical aging temperature range of 150-220° C., the properties undergo rapid deterioration with increasing temperature and with increasing time at temperature.

Precipitation-hardening changes the mechanical properties of an aluminum alloy by precipitating clusters of atoms ("precipitates") from a super-saturated solid solution of alloying elements in the parent aluminum phase. As the precipitates form, they distort the lattice, impeding the motion of dislocations. It is the impediment to dislocation motion that causes the change in properties; the hardness and strength increase and the ductility decreases.

The formation of precipitates is affected by time and temperature; at low temperatures, the precipitation reaction is sluggish and takes a large amount of time and at higher temperature, the reaction occurs more quickly due to higher atomic mobility.

At a given temperature, the strength and hardness increase with holding time at temperature until most of the potential second phase forms. With increased holding time, the individual precipitates undergo two fundamental changes; firstly, some particles grow at the expense of others. Through diffusion of alloying elements, some particles will shrink and eventually disappear whereas other will grow in size. This leads to a fewer number of larger precipitates. The larger distance between the fewer precipitates improves dislocation mobility leading to a decrease in hardness and strength and an increase in ductility. Additionally, as the precipitates grow in size, the strain energy between the precipitate and the aluminum lattice increases to a point where it becomes energetically feasible for the interface atomic bonds to be broken and form a separate phase boundary. This reduces the strain energy in two ways; the trans-boundary bonds are broken, allowing more separation and therefore less lattice distortion and since the crystal structures of the parent and precipitate lattices are different, they will no longer be forced to accommodate both sets of lattice parameters at the cluster-parent interface.

When the interface is still intact the distortion due to the disregistry is equal and opposite in the two phases. The zone of distortion reaches out beyond the chemical interface, disturbing the orderly arrangement of the lattice in the parent phase. This distortion allows the precipitate to have a disproportionately large impact on the mechanical properties. The effective radius of the precipitate is the chemical radius plus a fraction of the distortion zone because the distortion zone also impedes the motion of dislocations and dislocation account for the mechanical response of the material to a deformation load. The interface breaks down as the chemical radius increases in a gradual manner; first it becomes partial coherent, and then incoherent. At high levels of incoherency, the mechanical properties of the system begin to decrease with further precipitate growth because the effective radius of the precipitate is now decreasing due to a loss of lattice strain in the parent phase. The loss of effective radius coupled with the reduction in precipitate density described above, are accompanied by a loss in mechanical properties and conversely an increase in tensile ductility this phenomenon is known as over-aging.

Therefore, there is a need for improved castable aluminum alloy components and for methods of making them, especially at elevated temperature conditions.

SUMMARY OF THE INVENTION

This invention provides methods and techniques in alloying optimization and casting and heat treatment process control to produce castable and heat treatable aluminum alloy components with enhanced mechanical properties and strength for room and elevated temperature structural applications.

One aspect of the invention is an aluminum alloy component. Generally, the alloy may include about 0.6 to about 14.5 wt % silicon, 0 to about 0.7 wt % iron, about 1.8 to about 4.3 wt % copper, 0 to about 1.22 wt % manganese, about 0.2 to about 0.5 wt % magnesium, 0 to about 1.2 wt % zinc, 0 to about 3.25 wt % nickel, 0 to about 0.3 wt % chromium, 0 to about 0.5 wt % tin, about 0.0001 to about 0.4 wt % titanium, about 0.002 to about 0.07 wt % boron, about 0.001 to about 0.07 wt % zirconium, about 0.001 to about 0.14 wt % vanadium, 0 to about 0.67 wt % lanthanum, and the balance predominantly aluminum plus any remainders. Further, the weight ratio of Mn/Fe is between about 0.5 and about 3.5.

Another aspect of the invention involves a method for producing an Al—Si alloy cast component. In one embodiment, the method includes: providing a mold of the component; pouring a molten metal comprising the Al—Si alloy into the mold; and solidifying the molten metal in the mold with a controlled cooling rate. Any primary Si present is substantially uniformly dispersed within the solidified casting.

DETAILED DESCRIPTION OF THE INVENTION

High strength and high corrosion-resistant aluminum alloys are provided. In comparison with commercial alloys such as 360 and 380, these alloys should exhibit better corrosion resistance and higher mechanical properties at elevated temperature conditions such as those encountered in operating internal combustion engines (ICEs), and their components, such as engine blocks and cylinder heads. Moreover, the improved strength at both room temperature and elevated temperatures of the cast aluminum alloy components extend their acceptance and use in other structural applications, such as transmission cases and suspension components. Another benefit would be a significant reduction in the warranty cost of cast aluminum components in these and other automotive applications. A further benefit would be a weight reduction for the components, increasing mileage and decreasing cost.

The alloy may also contain at least one of the castability and strength enhancement elements such as silicon, manganese, iron, copper, zinc, silver, magnesium, nickel, germanium, tin, calcium, and scandium, yttrium and cobalt. The microstructure of the alloy can include at least one or more insoluble solidified and/or precipitated particles with at least one rare earth element or one alloying element.

Generally, the alloy may include about 0.6 to about 14.5 wt % silicon, 0 to about 0.7 wt % iron, about 1.8 to about 4.3 wt % copper, 0 to about 1.22 wt % manganese, about 0.2 to about 0.5 wt % magnesium, 0 to about 1.2 wt % zinc, 0 to about 3.25 wt % nickel, 0 to about 0.3 wt % chromium, 0 to about 0.5 wt % tin, about 0.0001 to about 0.4 wt % titanium, about 0.002 to about 0.07 wt % boron, about 0.001 to about 0.07 wt % zirconium, about 0.001 to about 0.14 wt % vanadium, 0 to about 0.67 wt % lanthanum, and the balance predominantly aluminum plus any remainders.

In some embodiments, the alloy may consist essentially of between about 1.1 to about 7.0 wt % silicon, 0 to about 0.7 wt % iron, about 4.13% wt copper, about 1.14 wt % manganese, between about 0.2 to about 0.5 wt % magnesium, about 0.2 wt % zinc, about 0.12 wt % nickel, about 0.15 wt % chromium, about 0.019 wt % tin, about 0.379 wt % titanium, about 0.066 wt % boron, about 0.624 wt % zirconium, about 0.078 wt % vanadium, about 0.032 wt % lanthanum, and the balance predominantly aluminum plus any remainders.

In another embodiment, the alloy may consist essentially of about 1 wt % silicon, 0 to about 0.7 wt % iron, about 4.13% wt copper, about 1.14 wt % manganese, between about 0.2 to about 0.5 wt % magnesium, about 0.2 wt % zinc, about 0.12 wt % nickel, about 0.15 wt % chromium, about 0.019 wt % tin, about 0.379 wt % titanium, about 0.066 wt % boron, about 0.624 wt % zirconium, about 0.078 wt % vanadium, about 0.032 wt % lanthanum, and the balance predominantly aluminum plus any remainders.

In another embodiment, the alloy may consist essentially of about 7 wt % silicon, 0 to about 0.7 wt % iron, about 4.13% wt copper, about 1.14 wt % manganese, between about 0.2 to about 0.5 wt % magnesium, about 0.2 wt % zinc, about 0.12 wt % nickel, about 0.15 wt % chromium, about 0.019 wt % tin, about 0.379 wt % titanium, about 0.066 wt % boron, about 0.624 wt % zirconium, about 0.078 wt % vanadium, about 0.032 wt % lanthanum, and the balance predominantly aluminum plus any remainders.

Controlled solidification and heat treatment improves microstructural uniformity and refinement and provides the optimum structure and properties for the specific casting conditions. In some embodiments, the alloy may grain-refined with Ti and B at a concentration of no less than about 0.01% and about 0.002% by weight, respectively.

For conventional high pressure die castings (HPDCs), sand and permanent mold casting, the solution treatment temperature for the proposed alloys is typically between about 400° C. and about 540° C. with a preferable temperature range of about 450° C. to about 525° C. The rapid cooling of the castings can be accomplished by quenching the castings into warm water, forced air or gases. The aging temperature is generally between about 160° C. and about 250° C., with a preferable temperature range of about 180° C. to about 220° C.

When alloys are used for full T6/T7 or T4 heat treatment, the solution treatment temperature should be neither lower than about 400° C. and nor higher than about 540° C. The lower limit is determined by the Solvus temperature of the composition and the upper limit is the Solidus of the alloy. Generally, a higher solution temperature accelerates the reactions but limitations to standard current furnace control technology dictate maintaining the maximum target temperature a safe level below the maximum theoretical, thus the preferable solution treatment temperature should be controlled between about 480° C. and about 525° C.

When high Si (near eutectic composition 12-14 wt % Si) is used, high content of Mg (above about 0.45%) and B (about 0.05 to about 0.1 wt %) should be used to refine the eutectic (Al+Si) grains.

Improved Strengthening

Cast aluminum alloys are usually subject to heat treatment including at least aging prior to machining. Artificial aging (T5) produces precipitation hardening by heating the aluminum castings to an intermediate temperature and then holding the castings for a period of time to achieve hardening or strengthening through precipitation. Considering that precipitation hardening is a kinetic process, the contents (supersaturation) of the retained solute elements in the as-cast aluminum solid solution play an important role in the aging responses of the aluminum castings. Therefore, the actual content of the hardening solutes in the aluminum soft matrix solution after casting is important for subsequent aging. A high cooling rate, as found in the HPDC process for example, results in a higher element concentration in the aluminum solution compared with a lower cooling rate, such as found in the sand casting process.

As seen in the following table, an alloy within the range of the embodiment described in [0016] further comprising 1.1% Si, 0.3% Fe and 0.35% Mg has been tested against commercially available alloys under different heat treatments. As can be seen, the subject alloy compares favorable across many of the measurement criteria, especially when comparing the ultimate tensile strength and the yield strength at 250° C. This property is especially significant considering the ability to also have a relatively high ultimate tensile strength and yield strength at room temperature.

| | Commercial Alloys | | | Subject Alloy | | |
|---|---|---|---|---|---|---|
| Alloy selected | A356 | 319 | 319 | Applicant | Applicant | Applicant |
| Heat treatment | T6 | as-cast | T7 | T6 | T63-2 | T52 |
| Ultimate tensile strength at room temperature (MPa) | 265 | 227 | 313 | 378 | 417 | 245 |
| Yield strength at room temperature (MPa) | 195 | 156 | 258 | 334 | 360 | 170 |
| % Elasticity at room temperature | 4.6 | 1.39 | 4.32 | 1.5 | 1.8 | 2.3 |
| Ultimate tensile strength at 250 C. (MPa) | 88 | 98 | 90 | 91 | 182 | 130 |
| Yield strength at 250 C. | 74 | 76 | 78 | 80 | 90 | 105 |
| % Elasticity at 250 C. | 22 | 16.4 | 20.06 | 17.6 | 12 | 3.8 |
| Solution treatment of the alloy | 5 hr at 530 C. | NA | 4 hr at 485 C. | 5 hr at 495 C. | 3 hr at 490 C.-3 hr followed by 2 hr at 515 C. followed by 2 hr at 530 C. | NA |
| Method of quenching the alloy | water | NA | forced air | water | water | NA |
| Aging process for the alloy | 4 hr at 220 C. | NA | 4 hr at 230 C. | 8 hr at 180 C. | 0.5 hr at 240 C. followed by 6 hr at 180 C. | NA |

Mg, Cu and Si are effective hardening solutes in aluminum alloys. Mg combines with Si to form Mg/Si precipitates such as β", β' and equilibrium $Mg_2Si$ phases. The actual precipitate type, amount, and sizes depend on aging conditions. Underaging tends to form shearable β" precipitates, while in peak and over aging conditions unshearable β' and equilibrium $Mg_2Si$ phases form. In aluminum alloys, Si alone can form Si precipitates, but the strengthening is very limited, and not as effective as Mg/Si precipitates. Cu can combine with Al to form many metastable precipitate phases, such as θ', θ, and the Q phase in Al—Si—Mg—Cu alloys. Similar to Mg/Si precipitates, the actual precipitate type, size, and amount depend on aging conditions and alloy compositions. Among those precipitates in cast aluminum alloys, Al/Cu precipitates and silicon precipitates can sustain a high temperature in comparison with Mg/Si precipitates.

To improve the aging response of cast aluminum alloy further, the magnesium content in the alloy should be kept no less than about 0.2 wt %, with the preferred level being above about 0.3 wt %. For the castings being subjected to only the T5 aging process, the maximum Mg content should be kept below about 0.4%, with a preferable level of about 0.35%, so that a majority of the Mg addition will stay in Al solid solution after rapid solidification as in high pressure die casting.

Improved High Temperature Behavior

The developed cast aluminum alloys have good elevated temperature properties since the alloys contain a large volume fraction of dispersed phases, which are thermodynamically stable at the intended service temperature. With additions of Fe, Ni and Mn in the cast aluminum alloys, a significant amount of thermal-stable eutectic dispersed phases, such as $Al_3Ni$, $Al_5FeSi$, $A_{15}FeMn_3Si_2$, and other intermetallic phases, forms during solidification. Adding Sc, Zr, Y and rare earth elements such as Yb, Er, Ho, Tm, and Lu also forms trialuminide compounds.

Other tetragonal crystal structures ($D0_{22}$ or $D0_{23}$) of trialuminides such as $Al_3Ti$, $Al_3Zr$, $Al_3Lu$, $Al_3Y$, etc, are closely related to the $L1_2$ structure and can be further transformed to the high-symmetry cubic $L1_2$ crystal by alloying with fourth-period transition elements such as Cr, Mn, Fe, Co, Ni, Cu, and Zn. Furthermore, the intermetallic $Al_3Zr$ precipitates as a coherent metastable $L1_2$ form. Partially substituting Ti for Zr reduces the lattice mismatch of the $L1_2$ precipitate with the Al matrix, thereby reducing the barrier to nucleation, increasing the stability of the $L1_2$ phase, and very substantially delaying the transformation to the tetragonal phase. Finally, Zr is a much more sluggish diffuser in Al than Sc which can offer enhanced coarsening resistance since the kinetics of Ostwald ripening are mediated by volume diffusion, as the solute is transferred through the matrix from the shrinking particles to the growing ones.

Improved Castability

Cu Addition

The addition of copper significantly decreases the melting point and eutectic temperature of the alloy. However, the copper increases the solidification range by formation of low melting point phases that form at the end of solidification range of the alloy and facilitates the condition of porosity formation.

The sequence of solidification and the formation of Cu-rich phases in Al—Si—Cu—Mg casting alloys during solidification can be described as follows:

(i) Formation of a primary α-aluminum dendritic network at temperatures below about 610° C., leading to a monotonic increase in the concentration of silicon, magnesium, and copper in the remaining liquid.

(ii) At about 577° C., the equilibrium aluminum-silicon eutectic temperature, the eutectic mixture of silicon and α-Al forms, leading to further increase in the copper content in the remaining liquid.

(iii) At about 540° C., $Mg_2Si$ and $Al_8Mg_3FeSi_6$ form. When the Cu content is greater than about 1.5%, however, the $Mg_2Si$ phase will not form for the alloy containing about 0.5% Mg by weight.

(iv) At about 525° C., the interdendritic, sometimes called "massive" or "blocky" $CuAl_2$ phase forms together with β-$Al_5FeSi$ platelets.

(v) At about 507° C., a eutectic of $CuAl_2$ with interspersed α-Al forms. In the presence of Mg, the Q phase ($Al_5Mg_8Cu_2Si_6$) also forms at this temperature, usually with an ultrafine eutectic structure.

Si Addition

Silicon provides several advantages to cast aluminum alloys, most of which applies irrespective of modification. The first and perhaps most important benefit of silicon is that it reduces the amount of shrinkage associated with the freezing of the melt. This is because solid silicon, with its non-close-packed crystal structure, is less dense than the Al—Si liquid solution from which it precipitates. It is generally accepted that shrinkage decreases almost in direct proportion to the silicon content, reaching zero at 25% Si. It is the shrinkage of the eutectic that is important for the castability of hypoeutectic alloys because the silicon in solid solution actually increases the density of the primary α-Al dendrites and therefore slightly increases shrinkage. The shrinkage of the α-Al is about 7% but this occurs while feeding is easy; the eutectic solidifies in the later stage, when feeding is more difficult, and is reported to have a shrinkage of about 4%. The eutectic alloy is more castable than the hypoeutectic alloy, as regards shrinkage defects.

The second benefit associated with silicon relates to its high latent heat of fusion. The latent heat of fusion of aluminum is 321 kJ/Kg and silicon is 1926 kJ/Kg, the higher latent heats from Si addition mean that the time-to-freezing is extended, and this improves fluidity as measured by, for example, the spiral fluidity test. It has been observed that the fluidity reaches a maximum in the range of about 14-16% Si.

Feeding is encouraged by a planar solidification front. Thus, feeding should be easier for pure metals or for eutectics than for alloys with a wide freezing range and an associated mushy zone. From the spiral fluidity test, it was found that the fluidity of Al—Si based alloys is highest near the eutectic composition. This is caused by two associated effects. First, silicon content appears to affect the dendrite morphology, with high silicon levels favoring rosettes and lower levels favoring classical dendrites. In general, rosette-shaped dendrites make feeding easier by delaying dendrite coherency and reducing the fraction of liquid trapped between the dendrite arms. Mold filling is more difficult in high-cooling rate processes such as permanent mold casting and high pressure die casting because the time-to-freezing is decreased. However, fluidity is increased as the composition approaches the eutectic. As a result, it is recommended to control the silicon content in the range of 5-9% for sand and investment castings (low cooling rates), 7-10% for permanent metal mould casting and 8-14% for high pressure die casting (highest cooling rates).

Fe and Mn Content

Iron is the major impurity in Al alloys, forming brittle complex intermetallics with Al, Si, Mg and minor impurities. These intermetallics seriously degrade the tensile ductility of the alloys. Moreover, because they often form during solidification of the eutectic, they affect castability by interfering with inter-dendritic feeding and thus promote porosity. The most commonly observed Fe-rich compound is the $Al_5FeSi$ (β-phase), usually found in the Al—$Al_5FeSi$—Si eutectic as thin platelets interspersed with the silicon flakes or fibers. If manganese is present, iron forms $Al_{15}(Fe,Mn)_3Si_2$ (α-phase), often in the shape of Chinese script. If enough magnesium is available, the compound $Al_8FeMg_3Si_6$ (π-phase) is formed, which has a Chinese script appearance if it is formed during the eutectic reaction, but is globular if it forms as a primary precipitate from the liquid. Rapid freezing refines the iron intermetallics and, thus, the magnitude of the effect of iron depends on the solidification rate in the casting.

These Fe-rich intermetallics are usually detrimental to corrosion resistance especially stress corrosion cracking because they compose a cathode pole (noble component of the electrical potential). Compared with other Fe-rich intermetallics such as α-$Al_{15}(Fe,Mn)_3Si_2$ and π-$Al_8FeMg_3Si_6$, β-$Al_5FeSi$ is more detrimental to corrosion resistance because of its high noble potential. The increased Cu content at about 1.5% by weight in the alloy increases the amount of noble $Al_2Cu$ phases facilitating Cu dissolution into α-$Al_{15}(Fe,Mn)_3Si_2$. This makes the potential of the α-$Al_{15}(Fe,Mn)_3Si_2$ intermetallics even nobler, causing a decrease in corrosion resistance.

Reduction and elimination of β-$Al_5FeSi$ can be achieved by controlling the Mn/Fe ratio and the total amount of Mn+Fe. It is suggested to control the Mn/Fe ratio above about 0.5, preferably above about 1 or higher. The upper limit of the Mn/Fe ratio in the aluminum alloy for die castings is defined to be about 3.0 or less. The total amount of Mn+Fe should be controlled in a range from about 0.5 to about 1.5% for minimizing die soldering and the detrimental effect of the Fe-rich intermetallics on ductility of the materials. The preferable total amount of Mn+Fe should be controlled in a range from about 0.8 to about 1.2%.

A high Fe level (greater than about 0.5% by weight) may be used for metal mold casting including high pressure die casting to avoid hot tearing and die soldering problems. With the use of Sr (above about 500 ppm), the moderate Fe level (0.4-0.5 wt %) can be used for metal mold casting including high pressure die casting. A lower Fe level (less than about 0.5% by weight) may be used for other casting processes. In the presence of Fe, the Mn content may be kept at a level to produce a Mn/Fe ratio greater than about 0.5 with a preferable ratio greater than about 1.

Other Elements

To facilitate the aging process, the alloy may contain Zn with a concentration above about 0.5% by weight. The cast aluminum alloys may also contain one or more elements such as Zr (0 to about 0.2 wt %), Sc (0 to about 1 wt %), Ag (0 to about 0.5 wt %), Ca (0 to about 0.5 wt %), Co (0 to about 0.5 wt %), Cd (0 to about 0.3%), Cr (0 to about 0.3 wt %), In (0 to about 0.5 wt %) in the aluminum alloy for special property and performance requirements.

It is noted that terms like "preferably," "commonly," and "typically" are not utilized herein to limit the scope of the claimed invention or to imply that certain features are critical, essential, or even important to the structure or function of the claimed invention. Rather, these terms are merely intended to highlight alternative or additional features that may or may not be utilized in a particular embodiment of the present invention.

For the purposes of describing and defining the present invention it is noted that the term "device" is utilized herein to represent a combination of components and individual components, regardless of whether the components are combined with other components. For example, a "device" according to the present invention may comprise an electrochemical conversion assembly or fuel cell, a vehicle incorporating an electrochemical conversion assembly according to the present invention, etc.

For the purposes of describing and defining the present invention it is noted that the term "substantially" is utilized herein to represent the inherent degree of uncertainty that may be attributed to any quantitative comparison, value, measurement, or other representation. The term "substantially" is also utilized herein to represent the degree by which a quantitative representation may vary from a stated reference without resulting in a change in the basic function of the subject matter at issue.

Having described the invention in detail and by reference to specific embodiments thereof, it will be apparent that modifications and variations are possible without departing from the scope of the invention defined in the appended claims. More specifically, although some aspects of the present invention are identified herein as preferred or particularly advantageous, it is contemplated that the present invention is not necessarily limited to these preferred aspects of the invention.

What is claimed is:

1. A cast aluminum-based component comprising, in weight percentages: about 1.1 to about 7.0 Si; about 0 to about 0.7 Fe; about 4.13 Cu; about 1.14 Mn; about 0.2 Mg; about 0.2 Zn; about 0.12 Ni; about 0.15 Cr; about 0.019 Sn; about 0.379 Ti; about 0.066 B; about 0.624 Zr; about 0.078 V; about 0.032 La; the balance being predominantly aluminum plus any remainders; wherein a weight ratio of Mn/Fe is between about 0.5 and about 3.5.

2. The component of claim 1, wherein the weight percentage of Si is about 1.1.

3. The component of claim 1, wherein the weight percentage of Si is about 7.

4. The component of claim 1, wherein the combined weight percentages of Mo, Co, Nb, and Y are less than about 0.2.

5. The component of claim 1, wherein the component is a cylinder head, engine block, wheel, pistons, bracket, case, or suspension.

* * * * *